US005732590A

United States Patent [19]

Heitze et al.

[11] Patent Number: 5,732,590

[45] Date of Patent: Mar. 31, 1998

[54] SUPPORTING FRAME OF A SLAB UPSETTING PRESS

[75] Inventors: Gerhard Heitze, Netphen, Germany; Adolf Müller, Wilnsdorf, Germany

[73] Assignee: SMS Schloemann-Siemag Aktiengesellschaft, Düsseldorf, Germany

[21] Appl. No.: 716,581

[22] Filed: Sep. 19, 1996

[30] Foreign Application Priority Data

Sep. 22, 1995 [DE] Germany ..... 195 35 167.3

[51] Int. Cl.[6] ..... B21D 37/12; B21J 13/04

[52] U.S. Cl. ..... 72/455; 72/456; 72/206

[58] Field of Search ..... 72/455, 456, 206, 72/407, 416

[56] References Cited

U.S. PATENT DOCUMENTS

| | | | |
|---|---|---|---|
| 2,417,697 | 3/1947 | Loomis | 72/455 |
| 3,581,656 | 6/1971 | Pappas et al. | 72/455 |
| 3,895,512 | 7/1975 | Sack . | |
| 5,394,723 | 3/1995 | Benz | 72/455 |

FOREIGN PATENT DOCUMENTS

| | | | |
|---|---|---|---|
| 0599302 | 6/1994 | European Pat. Off. . | |
| 74710 | 4/1986 | Japan | 72/206 |
| 317603 | 12/1989 | Japan | 72/206 |
| 169407 | 7/1991 | Japan | 72/206 |

*Primary Examiner*—David Jones
*Attorney, Agent, or Firm*—Friedrich Kueffner

[57] ABSTRACT

A supporting frame of a slab upsetting press includes a supporting frame for receiving a pair of upsetting slides and tool slides connected to the pair of upsetting slides. The supporting frame includes two housing beams supporting the pair of upsetting slides and, arranged spaced above the housing beams supporting the pair of upsetting slides, two additional housing beams, and connecting beams which connect the respective ends of the housing beams and receive the bearings of the screw-down spindles or the balancing pistons. The individual housing beams form independent structural elements, wherein the housing beams arranged one above the other form a pair of housing beams whose ends have plane side surfaces which can be placed on corresponding plane side surfaces of crossheads which are also constructed as independent structural components and receive the bearings of the screw-down spindles and can be connected by screws to the crossheads.

3 Claims, 3 Drawing Sheets

1
1a
2
2a
3
3a
4
5
6
7
8
12
12a
13
14
15
16
17
18
19
20
21

1a
22
1

1a
1b
1b 1a
1b
1b
1

2a
2b
2b
24
2

2b
2a 2b
2a
2b
2

SUPPORTING FRAME OF A SLAB UPSETTING PRESS

BACKGROUND OF THE INVENTION

1. Field of the Invention

The present invention relates to the configuration of a supporting frame of a slab upsetting press, wherein the supporting frame receives the pair of upsetting slides and the tool slides connected to the pair of upsetting slides. The supporting frame includes two housing beams supporting the pair of upsetting slides and, arranged spaced above the housing beams supporting the pair of upsetting slides, two additional housing beams, and connecting beams which connect the respective ends of the housing beams and receive the bearings of the screw-down spindles or the balancing pistons.

2. Description of the Related Art

In the past, the supporting frames of slab upsetting presses of the above-described type were always cast of steel in a single piece in order to take into account the various pressure components occurring during the upsetting process. However, the increasing external dimensions of the supporting frames occurring with the development of the slab upsetting presses made it increasingly more difficult to mechanically work the supporting frames and to transport the supporting frames.

SUMMARY OF THE INVENTION

Therefore, it is the primary object of the present invention to provide a supporting frame of the above-described type whose elements can be worked in a simple manner and which can be transported with little difficulty.

In accordance with the present invention, the individual housing beams form independent structural elements, wherein the housing beams arranged one above the other form a pair of housing beams whose ends have planar side surfaces which can be placed on corresponding planar side surfaces of crossheads which are also constructed as independent structural components and receive the bearings of the screw-down spindles and can be connected by means of screws to the crossheads.

The structural elements of the configuration of the supporting frame of a slab upsetting press according to the present invention can be processed on small machine tools, some even simultaneously, and it is not difficult to transport the elements during processing as well as later to the location where the press is to be assembled.

In accordance with another feature of the present invention, the housing beams may include cross-sectional portions in the form of I-sections and the crossheads may have flange projections above and below the bearings of the screw-down spindles, wherein the outer sides of the flange projections can be placed onto the side surfaces of the ends of the housing beams.

The crossheads may have vertically extending planar contact surfaces which face each other for a preferably parallelepiped spacer box which can be placed between the adjacent crossheads of the two pairs of housing beams and which forms the respective connecting beam of the pairs of housing beams.

Locking projections and recesses receiving the locking projections may be provided in the planar surfaces which can be placed onto each other.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figures 1, 2:
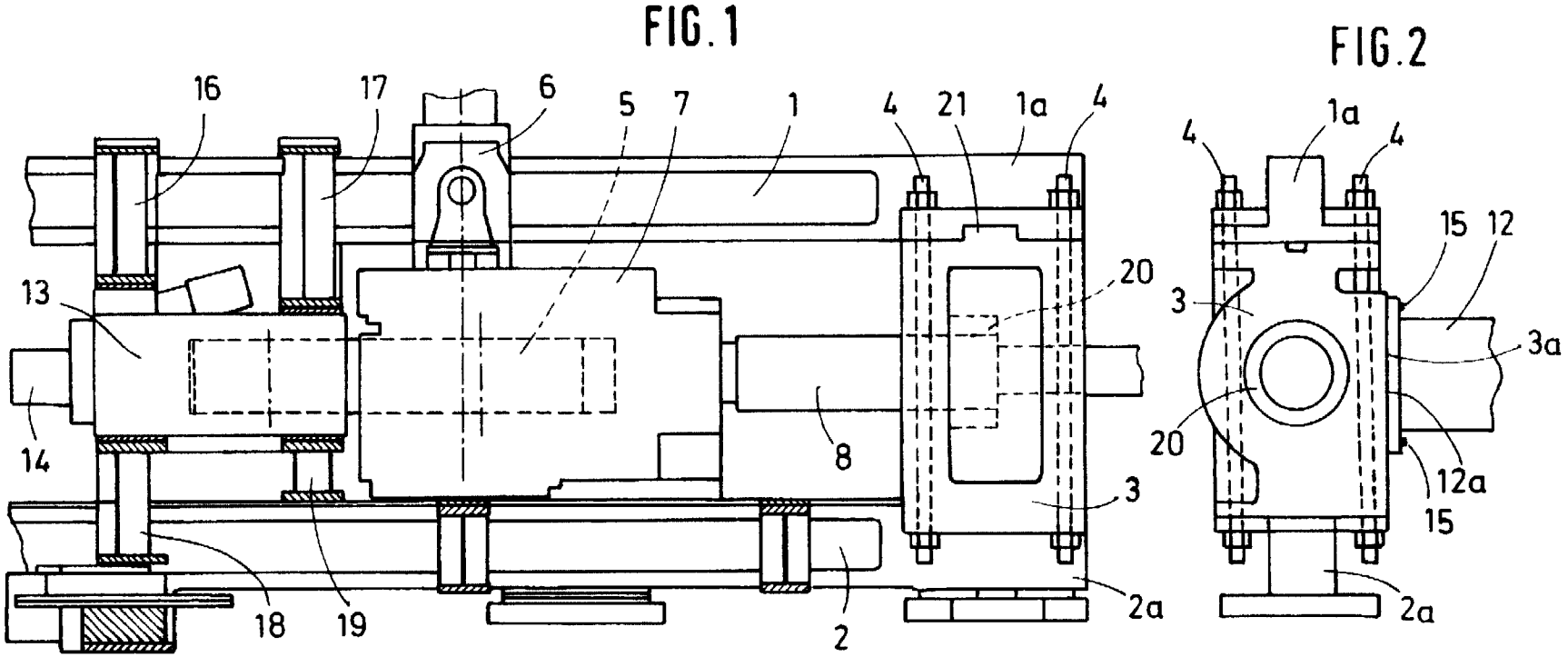
FIG. 1 is an elevational side view of a slab upsetting press.
FIG. 2 is a sectional side view of the slab upsetting press of FIG. 1.
Figure 3:
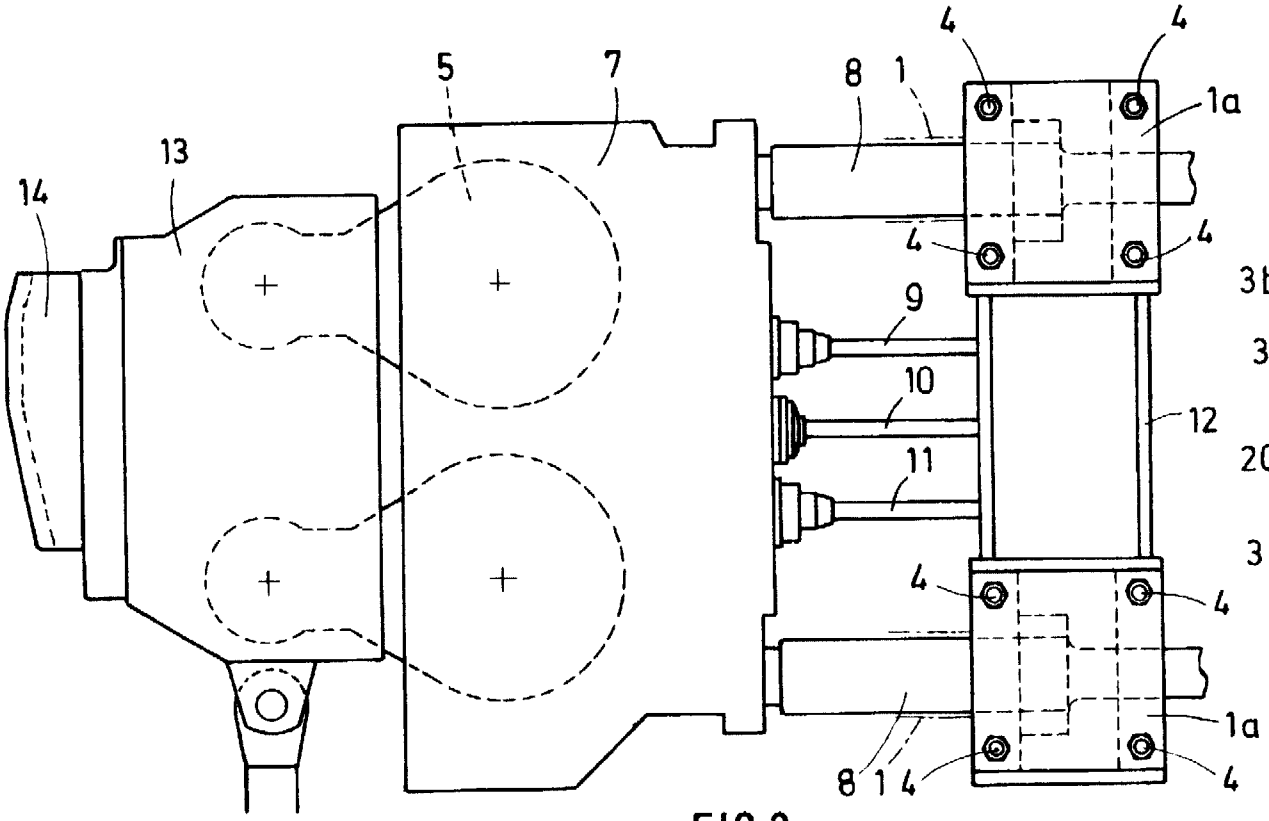
FIG. 3 is a top view of the slab upsetting press of FIG. 1.

FIGS. 1–3 show one side of a supporting frame of a slab upsetting press according to the present invention.

As shown in FIGS. 1–3, the supporting frame includes two pairs of upper and lower housing beams 1 and 2, respectively, whose ends 1*a*, 2*a* are connected with screwed connections by means of crossheads 3 and tension bolts 4.

The upsetting slide 7 receiving the connecting rod 5 driven from the top by means of an articulated spindle 6 is slidingly placed on the two lower housing beams 2 of the two pairs of housing beams 1, 2. A pair of screw-down spindles 8 resting against the respective crosshead 3 act on the rear side of the upsetting slide 7. In addition, the upsetting slide 7 is connected in an articulated manner to balancing pistons 19 and 11 whose cylinder units, not shown, are arranged in a parallelepiped-shaped spacer box 12. The spacer box 12 can be placed with planar side surfaces 12*a* onto corresponding side surfaces 3*a* of the crosshead 3 and is connected therewith by means of screws 13.

The connecting rods 5 are supported in the upsetting slide 13 which supports the upsetting tool 14 and which is braced by means of support beams 16, 17 and 18, 19 against the two upper housing beams 1 and the two lower housing beams 2.

Figure 5:
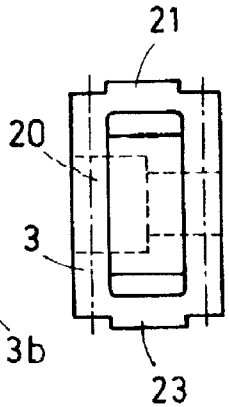
FIGS. 4 and 5 show details of the supporting frame of the slab upsetting press.
Figure 4:
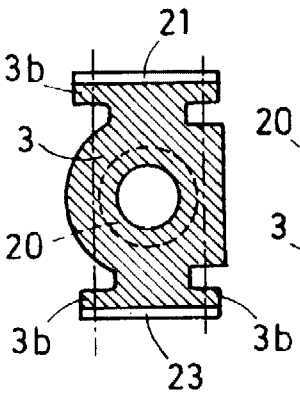

As shown in FIGS. 4 and 5, the crossheads 3 include a box-shaped intermediate part which receives the support bearings 20 for the screw-down spindle 8 and includes the plane side surface 3*a* for contacting the side surface 12*a* of the spacer box 12. At the upper and lower ends of the crosshead 3, the box shape changes into flange projections 3*b*, wherein the corresponding side surfaces of the ends 1*a* or 2*a* of the upper or lower housing beams 1 and 2 can be placed on the outer sides of the flange projections 3*b*.

Figures 6, 7, 8, 9, 10, 11:
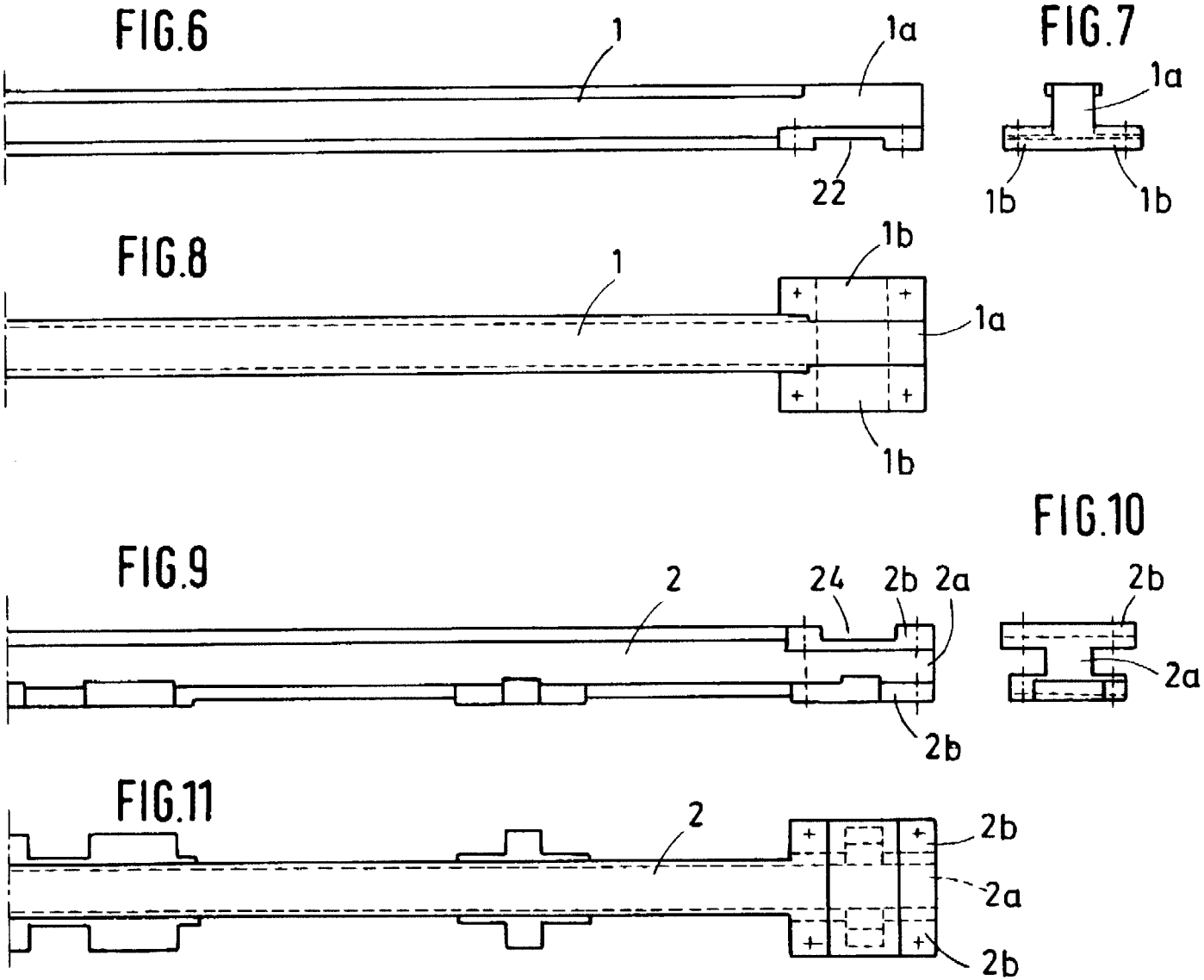
FIG. 6 is a partial side view of a housing beam of the supporting frame.
FIG. 7 is a side view of the housing beam of FIG. 6.
FIG. 8 is a top view of the housing beam of FIG. 6.
FIG. 9 is a side view of another housing beam of the supporting frame.
FIG. 10 is a side view of the housing beam of FIG. 9.
FIG. 11 is a top view of the housing beam of FIG. 9.

As illustrated in FIGS. 6, 7 and 8, each of the upper housing beams includes a portion having an I-shaped cross section between the ends 1*a*, wherein the ends 1*a* change over into horizontal T-shaped cross sections whose flanges are widened corresponding to the dimensions of the flange projections 3*b* of the crossheads 3.

As shown in FIGS. 9, 10 and 11, the lower housing beams 2 also have an i-shaped cross section between the two ends 2*a*, and the ends 2*a*, contrary to the configuration of the ends 1*a* of the upper housing beams 1, also form an I-shaped cross section whose flanges 2*b* are widened in accordance with the width of the side surface 3*a* of the crosshead 3.

Locking projections 21 and recesses 22 receiving the locking projections 21 are provided in the side surfaces of the flange projections 3*b* of the crossheads 3 and in the side surfaces of the ends 1*a* of the upper housing beams 1 which side surfaces can be placed on top of each other. Corresponding locking projections 23 and recesses 24 are provided in the lower portion of the flange projections 3*b* of the crosshead 3 and the ends 2*b* of the lower housing beams.

While specific embodiments of the invention have been shown and described in detail to illustrate the inventive principles, it will be understood that the invention may be embodied otherwise without departing from such principles.

We claim:

1. In a supporting frame of a slab upsetting press including a supporting frame receiving a pair of upsetting slides and tool slides connected to the pair of upsetting slides, the supporting frame having a top and a bottom and including two lower housing beams supporting the pair of upsetting slides and, arranged spaced above the lower housing beams supporting the pair of upsetting slides, two additional upper housing beams, connecting beams for connecting ends of the housing beams, and screw-down spindles mounted in bearings attached to the connecting beams, the improvement comprising each housing beam forming an independent structural element, wherein the housing beams arranged one above the other form pairs of housing beams, further comprising crossheads forming independent structural components and having planar side surfaces, the ends of each pair of housing beams having planar side surfaces configured to be placed on the planar side surfaces of the crossheads, wherein the crossheads receive the bearings of the screw-down spindles and screws are provided for connecting the crossheads to the bearings, wherein the housing beams comprise cross-sectional portions in the form of I-sections and the crossheads comprise flange projections above and below the bearings of the screw-down spindles, wherein the flange projections have outer sides facing away from the bearings and the outer sides of the flange projections are configured to be placed onto the side surfaces of the ends of the housing beams.

2. The supporting frame according to claim 1, wherein the crossheads comprise vertically extending planar contact surfaces which face each other for contacting planar side surfaces of a parallelepiped spacer box forming one of the connecting beams, the spacer box being configured to be placed between adjacent crossheads of the two pairs of housing beams.

3. The supporting frame according to claim 1, further comprising locking projections and recesses for receiving the locking projections in the planar surfaces of the ends of the housing beams and in the planar surfaces of the crossheads which are configured to be placed onto each other.

* * * * *